US011091228B2

(12) United States Patent
Cassanas et al.

(10) Patent No.: US 11,091,228 B2
(45) Date of Patent: Aug. 17, 2021

(54) INFLATABLE BOAT WITH D-SHAPED WALL

(71) Applicant: ZODIAC MILPRO INTERNATIONAL, Paris (FR)

(72) Inventors: Marc Cassanas, Figueres (ES); Guillaume Lacoste, Paris (FR)

(73) Assignee: ZODIAC MILPRO INTERNATIONAL, Paris (FR)

( * ) Notice: Subject to any disclaimer, the term of this patent is extended or adjusted under 35 U.S.C. 154(b) by 4 days.

(21) Appl. No.: 16/618,259

(22) PCT Filed: May 29, 2018

(86) PCT No.: PCT/EP2018/064007
§ 371 (c)(1),
(2) Date: Nov. 29, 2019

(87) PCT Pub. No.: WO2018/219909
PCT Pub. Date: Dec. 6, 2018

(65) Prior Publication Data

US 2020/0148307 A1 May 14, 2020

(30) Foreign Application Priority Data

May 29, 2017 (FR) ..... 1754712

(51) Int. Cl.
*B63B 7/08* (2020.01)

(52) U.S. Cl.
CPC ..... *B63B 7/082* (2013.01)

(58) Field of Classification Search
CPC ..... B63B 7/082; B63B 7/08; B63B 7/085; B63B 7/087; B63B 32/51; B63B 34/20; B63B 34/22; B63B 34/23
See application file for complete search history.

(56) References Cited

U.S. PATENT DOCUMENTS 3,170,174 A * 2/1965 Hanel ..... B63B 7/082 114/345
6,860,221 B1 * 3/2005 Henderson ..... B63B 3/08 114/352

(Continued)

FOREIGN PATENT DOCUMENTS

| | | | |
|---|---|---|---|
| EP | 0419888 | A1 | 4/1991 |
| LU | 40488 | A1 | 10/1961 |
| WO | 2012/007694 | A1 | 1/2012 |

OTHER PUBLICATIONS

International Search Report and Written Opinion, dated Jun. 27, 2018, from corresponding PCT application No. PCT/EP2018/064007.

*Primary Examiner* — Anthony D Wiest
(74) *Attorney, Agent, or Firm* — Nixon & Vanderhye

(57) ABSTRACT

Disclosed is a boat including a flexible bottom bordered radially towards the outside by a wall which includes an inflatable and flexible front wall, an inflatable and flexible lateral wall, and a rear wall. At least one part of at least one of the lateral wall and of the front wall is constituted by a first inflatable element configured as a panel having two parallel planar faces, a second inflatable element of which the cross section is in the form of a D with a planar portion, and a flexible assembly device, the second element being situated radially towards the outside of the boat with respect to the first element, the assembly device maintaining the planar portion of the second element in contact with one of the planar faces of the first element.

20 Claims, 2 Drawing Sheets

(56) References Cited

U.S. PATENT DOCUMENTS

| | | | |
|---|---|---|---|
| 8,789,486 | B2 | 7/2014 | Boudeau et al. |
| 2011/0155042 | A1 | 6/2011 | Kaye |
| 2015/0314832 | A1 | 11/2015 | Walker |

* cited by examiner

INFLATABLE BOAT WITH D-SHAPED WALL

BACKGROUND OF THE INVENTION

Field of the Invention

The present invention relates to a boat comprising a bottom that is flexible and radially edged towards the outside by a wall which comprises an inflatable and pliable front wall, an inflatable and pliable lateral wall, and a rear wall.

Description of the Related Art

Such boats have the advantage, compared to a boat of similar size with a stiff hull, of being significantly lighter and taking up a smaller volume when they are not in use. In fact, the front and lateral walls are inflatable and pliable, each forming an air-filled tube with circular section, and the floors deformable such that the entire boat can be deflated and folded up, with the possible exception of the rear wall. In fact, the rear wall is in general a panel made up of a material (for example wood) that is stiffer than the material of the tubes of the front and lateral walls because the rear wall is intended to support the boat's engine. Such a boat is referred to as an "inflatable boat".

In the following description, the terms "inner"/"interior" and "outer"/"exterior" are defined relative to the geometric center of the boat after inflation.

The terms "lower"/"upper" are defined relative to the vertical axis which is perpendicular to the bottom of the boat which extends in a horizontal plane during normal use of the boat.

The bottom of the boat is made up of a pliable fabric whose lateral walls are fixed to the lower surface of the tubes (and to the rear wall) such that these tubes form the front and lateral walls of the boat.

Thus, since the tubes for the front and lateral walls having a cylindrical shape with circular section, the inner radial half of the tubes are necessarily located above the floor of the boat.

Consequently, the inner space of the boat is reduced by half of the volume of the tubes, all along the front and lateral walls of the boat. The useful and habitable surface of the boat is thus reduced by as much, which is harmful.

SUMMARY OF THE INVENTION

The present invention aims to remedy these disadvantages.

The invention aims to propose an inflatable boat whose interior space is maximized, while the functional and operational properties of the boat remain the same as those of an inflatable boat according to the prior art.

This goal is achieved due to the fact that at least one part of at least one among the lateral wall and front wall is made of an inflatable first element shaped as a plate having two parallel flat surfaces, an inflatable second element whose section is D shaped with a flat portion, and a flexible assembly device, where the second element is located radially outward from the boat relative to the first element, and the assembly device keeps the flat portion of the second element in contact with one of the surfaces of the first element.

Because of these arrangements, the space available for the passengers on the boat is optimized. The stability of the boat is not however compromised because the walls have a substantially circular outer shape; the boat still has the same dimensions as a similar boat from the prior art. The boat also retains the property of complete inflatability (except possibly for the rear wall) and foldability thereof.

Advantageously, the assembly device is chosen among an attachment system, a flexible sleeve at least partially surrounding the first element and the second element, and a combination of the two.

Thus, the weight of the device for maintaining contact between the first element and the second element is minimized.

For example, the first element is located outside the second element.

Advantageously, the second element extends under the bottom of the boat.

Thus, the stability and steerability of the boat is improved.

For example, the first element is located inside the second element.

Advantageously, when only one part of the lateral wall and the front wall comprises the first element and the second element, the wall further comprises a progressive transition which connects this part with the rest of the wall.

Thus, an abrupt transition is avoided in the wall of the boat, which contributes to improving the strength thereof.

For example, all of the lateral wall comprises the first element and the second element, and the transition connects the lateral wall and the front wall.

Advantageously, all of the lateral wall and front wall comprise the first element and the second element.

Thus, the space available for the passengers in the boat is maximized.

Advantageously, the front wall, the second element, and if applicable the transition delimit a single volume inflatable from a single point.

Thus, the boat can be unfolded and inflated in the position of use thereof more quickly.

Advantageously, the bottom comprises a fabric on which a stiff removable floor can be placed.

Because of the removability of the floor, the boat keeps the inflatability and foldability thereof, while providing the passengers a more rigid support.

BRIEF DESCRIPTION OF THE DRAWINGS

The invention will be better understood and the advantages of thereof will appear more clearly upon reading the following detailed description of an embodiment shown as a nonlimiting example. The description refers to the attached drawings on which.

DESCRIPTION OF THE PREFERRED EMBODIMENTS

Figure 1:
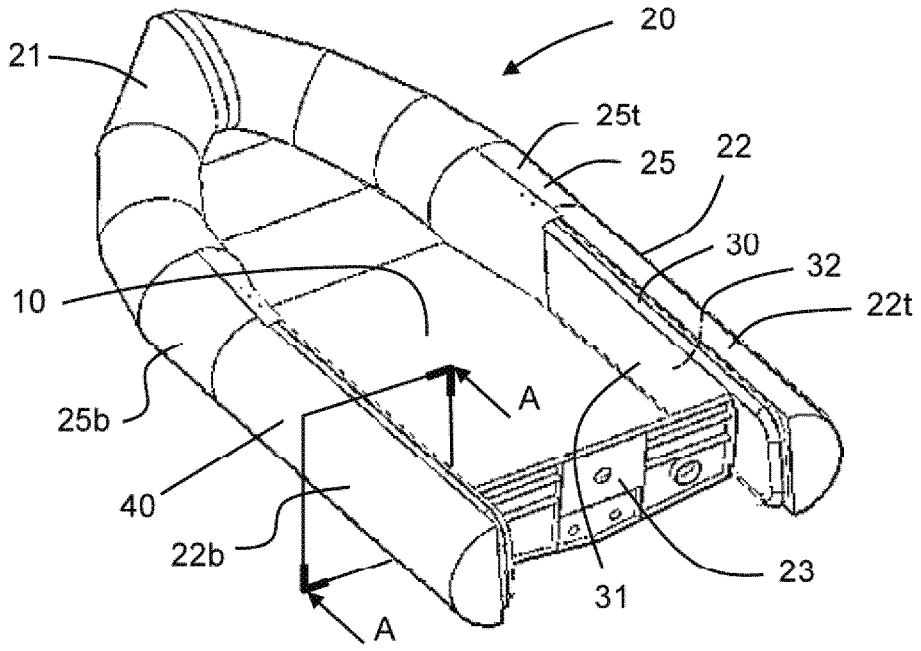
FIG. 1 is a perspective view of a boat according to the invention.

FIG. 1 shows a boat according to the invention. The boat comprises a flexible bottom 10 and a wall 20 which radially borders the bottom 10 on the outside.

"Flexible" element means an element for which one of the three dimensions is sufficiently small compared to the others and for which the stiffness of the material from which it is made is sufficiently low that it can be folded by hand.

"Inflatable" means an element made up of a flexible envelope delimiting a volume and having a pluggable opening with which to inflate the element by injection of air into the volume.

The bottom 10 is for example made up of a flexible fabric 11.

Advantageously, this bottom 10 can receive a removable floor 12 placed on this fabric 11 and which covers the entire surface of the bottom 10. Addition of the floor 12 serves to stiffen the bottom 10.

The floor 12 is for example an inflatable plate (similar to the element 30 described below). The floor 12 is thus made solely of a flexible material so that it can be folded.

Alternatively, the floor 12 is a rigid plate, either a single unit, or made up of plates hinged to each other.

As an option, the bottom 10 further comprises a rigid or inflatable keel 13. This improves the stability of the boat.

For example, the keel 13 is made up of a set of inflatable or rigid planks.

Alternatively, the keel 13 is made up of an inflatable tube or circular section which is arranged between the fabric 11 and the floor 12 which stretches the fabric 11 to give it the shape of a V-shaped ship bottom.

Figure 6:
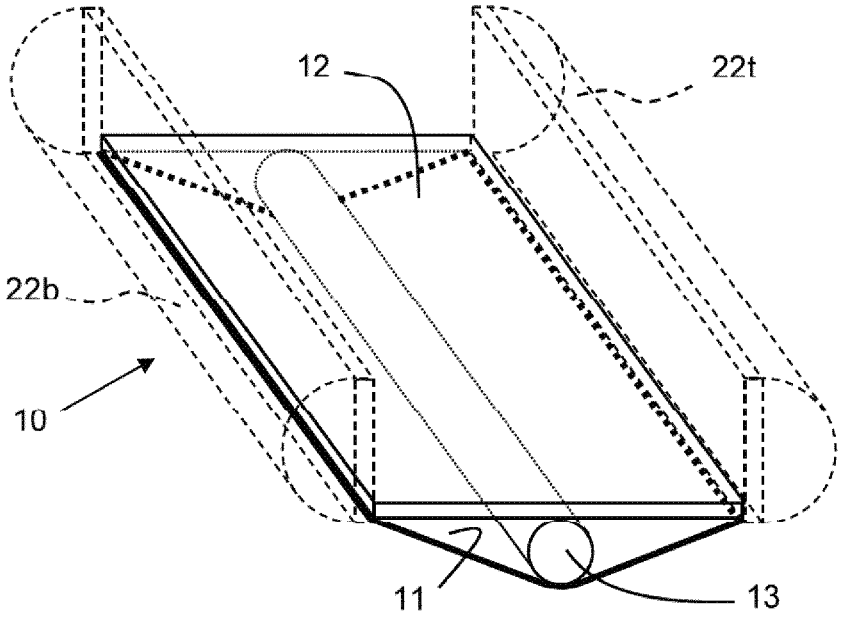
FIG. 6 is a perspective view of the bottom portion of a boat according to the invention.

FIG. 6 shows in perspective a longitudinal portion of such a bottom 10 of the boat with a rigid floor 12 and a keel 13, and the positions thereof relative to the lateral walls 22 (port wall 22*b* and starboard wall 22*t*) shown dotted and described below.

The wall 20 comprises an inflatable front wall 21 and an inflatable lateral wall 22. The front wall 21 is made up of the part of the wall 20 which forms the prow of the boat. The lateral wall 22 is made up of the part of the wall 20 which forms the lateral sides of the boat. Thus, the lateral wall 22 is made up of a port wall 22*b* and a starboard wall 22*t*, which extend substantially parallel to each other from the front wall 21 to the rear of the boat (to the rear wall 23). Since these two lateral walls (port 22*b* and starboard 22*t*) are symmetric about the central longitudinal axis of the boat, the description below of the port wall 22*b* also applies to the starboard wall 22*t*.

The periphery of the bottom 10 of the boat, made up by the edges of the bottom 10, is fixed to the front wall 21, the lateral wall 22, and the rear wall 23. They are fixed near the lower part of these walls, as can be seen in the figures. The lateral wall 22 is also fixed to the rear wall 23.

A first embodiment is described with reference to FIG. 1 and FIG. 3 first.

The front wall 21 is formed of a tube of circular cylindrical section.

The periphery of the bottom 10 is fixed to the lower end of the vertical diameter of this tube.

The port wall 22*b* comprises a plate-shaped inflatable first element 30 having two parallel flat surfaces, where these flat surfaces are an inner flat surface 31 and an outer flat surface 32.

The first element 30 is plate-shaped because of flexible connections (threads or fibers or ribbons) which connect the inner surface 31 and the outer surface 32 such that the distance between these surfaces is substantially constant over the entire surface of the first element 30. These connections 33 are fixed (for example by adhering or sewing) to the inner surface 31 and to the outer surface 32. These connections 33 can be seen in FIG. 3.

The port wall 22*b* further comprises an inflatable second element 40 who section is D shaped and which is located radially outward from the first element 30. The flat portion 41 of the second element 40 is the straight part of the "D", and is in contact (direct, or indirect by the attachment system 70, see below) with the outer surface 32 of the first element 30. The first element 30 is thus located outside of the second element 40.

This contact between the first element 30 and the second element 40 is made exclusively by a flexible assembly device, which allows the wall 20 to keep the flexibility and foldability thereof (with the possible exception of the rear wall 23).

For example, this contact is made by attaching the flat portion 41 of the second element 40 onto the outer surface 32 of the first element 30 using an attachment system 70 (for example made of an adhesive and/or lacing and/or Velcro) which therefore constitutes the assembly device.

Alternatively, or additionally, this contact is made with the help of a flexible sleeve 60 in which the first element 30 and the second element 40 are housed. Advantageously, the sleeve 60 contributes to shaping the first element 30 into the flat shape thereof and the second element 40 into the D shape thereof. For example, the sleeve 60, which is fixed to the second element 40 by the attachment system 70, forms a tubular cell into which the first element 30 can be inserted (slid) such that the sleeve 60 completely surrounds the first element 30, except for the ends thereof. This embodiment has the advantage that the first element 30 can be removed from the sleeve 60 for repair and then put back into the sleeve 60 in order to be assembled with the second element 40 via the sleeve 60. As an option, the sleeve 60 forms another tubular cell shaped for receiving the second element 40 without the need for a system for attachment 70 of the sleeve 60 on the second element 40.

Other combinations than those described above are possible, and in the general case, the flexible sleeve 60 and/or the attachment system 70 constitute the device for assembly of the first element 30 with the second element 40.

Figure 3:
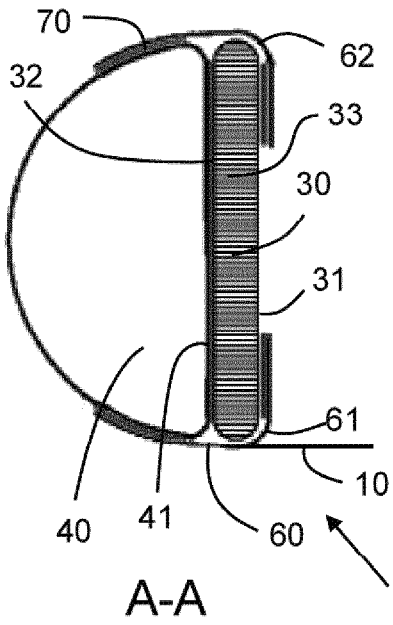
FIG. 3 is a transverse section of the wall of the boat from FIG. 1 along the plane A-A.

As shown as an example in FIG. 3, which is a transverse section of the port wall 22*b* of the lateral wall 22 along the plane A-A of FIG. 1, the sleeve 60 is formed of a lower portion 61 which covers the lower edges of the first element 30 and that the second element 40, and an upper portion 62 which covers the upper edges of the first element 30 and of the second element 40. The lower portion 61 is fixed by the attachment system 70 which here is an adhesive on both the lower part of the first element 30 and the lower part of the second element 40, and the upper portion 62 is adhered by the adhesive 70 both on the upper part of the first element 30 and the upper part of the second element 40 such that after inflation of the first element 30 and the second element 40, the flat portion 41 of the second element 40 is in contact with the outer surface 32 of the first element 30. The upper portion 61 and the lower portion 62 are distinct. Alternatively they are joined by covering the rounded surface of the D of the port wall 22*b*, meaning the radially outer surface of this wall.

Optionally, the flat portion 41 is adhered with the outer surface 32 by the adhesive 70, which contributes to securing the port wall 22*b* and to keeping the flat portion 41 the flattest possible.

The periphery of the bottom 10 is fixed to the lower end of the port wall 22*b*, for example at the lower end of the first element 30, or the lower portion 61 of the sleeve 60 in the case where this sleeve 60 is present.

The wall 20 comprises a progressive transition 25 (seen in FIG. 1) which connects the lateral walls 22 and the front wall 21 where this transition 25 is made up of a port transition 25*b* which connects the port wall 22*b* and the front wall 21, and a starboard transition 25*t* which connects the starboard wall 22*t* and the front wall 21.

The port transition 25*b* (and by symmetry the starboard transition 25*t*) is formed of a cylinder with a transverse section (meaning in the plane transverse to the direction of the tube of the wall 20) transitioning from a circular section in the area of the junction of the port transition 25*b* with the front wall 21, to a D section in the area of the junction of the port transition 25*b* with the second element 40. This transition of the shape of the port wall 25*b* is done progressively, which avoids concentrations of stresses in the wall 20 and contributes to the solidity of the boat.

In general, when only part of the lateral wall 22 and the front wall 21 comprise the first element 30 and the second element 40, the wall 20 further comprises the transition 25.

The front wall 21, the transition 25, and the second element 40 delimit a single volume inflatable from a single point. Inflating the boat is thus more practical.

Alternatively, the wall 20 of the boat is compartmentalized into several distinct and separately inflatable sections, for example near junctions between the front wall 21, the transition 25 and the second element 40. In that way deflation of the entire boat is avoided if it is punctured by accident in one area.

The first element 30 forms a separate volume from the second element 40, which is inflated separately therefrom.

Alternatively, the volume of the first element 30 is connected with the volume of the second element 40 through a pressure relief valve.

In this case, the front wall 21, the lateral wall 22, and if applicable the transition 25 delimit a single volume inflatable from a single point.

The inflation pressure of the first element 30 is greater than the inflation pressure of the second element 40, for example 4 to 5 times larger. For example, the inflation pressure of the second element 40 is of order 200 to 250 mbar (millibars), and the inflation pressure the first element 30 is of order 1000 mbar.

In the embodiment described above, the transition 25 is between the front wall 21 and the lateral wall 22.

As a variant, the transition 25 is located at a given place along the front wall 21.

As a variant, the transition 25 is located at a given place along the lateral wall 22.

Figure 2:
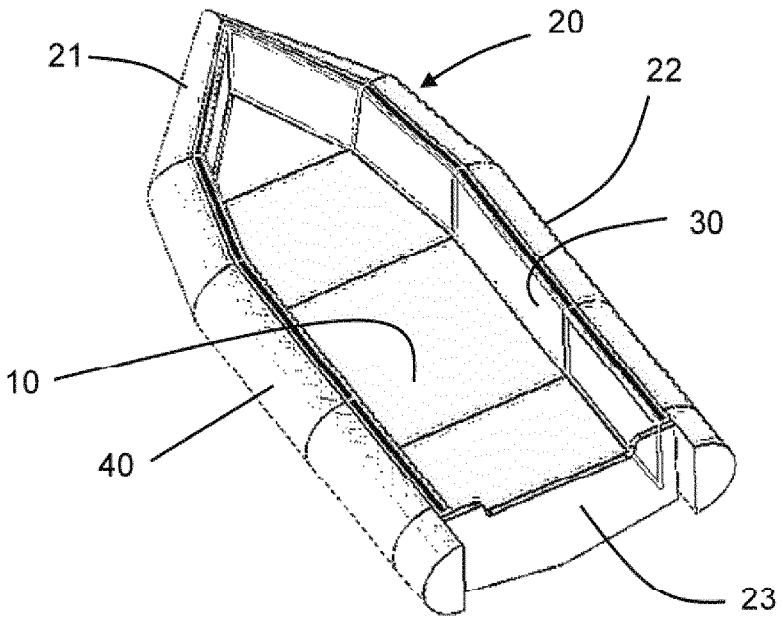
FIG. 2 is a perspective view of another embodiment of a boat according to the invention.

FIG. 2 shows another embodiment of a boat according to the invention.

All of the lateral wall 22 and front wall 21 comprise the first element 30 and the second element 40. Thus, there is no transition 25 in the wall 20, which is formed solely of the first element 30 and the second element 40.

This embodiment has the advantage that the dimensions of the cabin of the boat are maximized.

Figure 4:
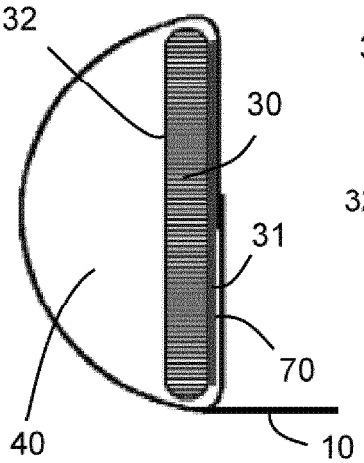
FIG. 4 is a transverse section of the wall of a boat according to another embodiment of the invention.

FIG. 4 shows an embodiment of the wall of the boat according to the invention, which applies equally to the embodiment of the boat from FIG. 1 and FIG. 2. The first element 30 is located inside the second element 40. The flat portion 41 of the second element 40 is then in contact with the inner surface 31 of the first element 30.

In this case, a sleeve 60 is not necessary, since the inner surface 31 of the first element 30 is fixed by the attachment system 70 onto the surface of the flat portion 41 of the second element 40 which is located within the volume of this second element 40. Thus, the solidity of the port wall 22*b* and to keep the flat portion 41 the flattest possible.

The periphery of the bottom 10 is fixed to the lower end of the port wall 22*b*.

Figure 5:
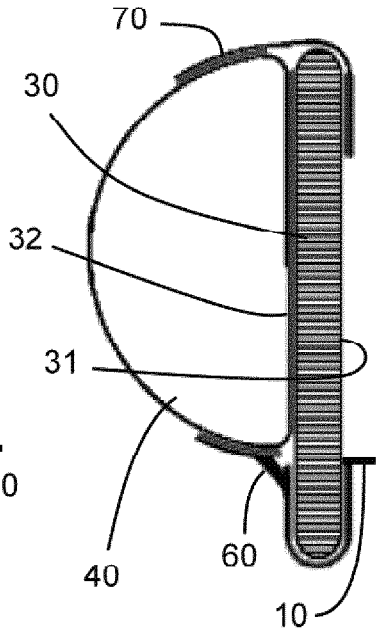
FIG. 5 is a transverse section of the wall of a boat according to another embodiment of the invention.

FIG. 5 again shows an embodiment of the wall of the boat according to the invention, which is a variant of the embodiment from FIG. 3, and which applies equally to the embodiment of the boat from FIG. 1 and FIG. 2. The difference between these two embodiments is that the first element 30 extends vertically downward below the bottom 10 of the boat.

Thus, the periphery of the bottom 10 is fixed to the lower end of the second element 40 of the port wall 22*b*.

The invention was described above in the case where the second element 40 on the port and starboard of the boat is a tube with D cross-section. Alternatively, the second element 40 is made of an assembly of tubes 44, for example with circular cross-section, and various widths (or diameters) such that this assembly occupies a D-shaped volume. The tubes for this assembly are held in contact near their lines of contact directly by an attachment means (for example by adhering with an adhesive or by lacing, or sewing, or by Velcro), and/or indirectly by a sleeve 60.

For example, these tubes are all identical.

Figure 7:
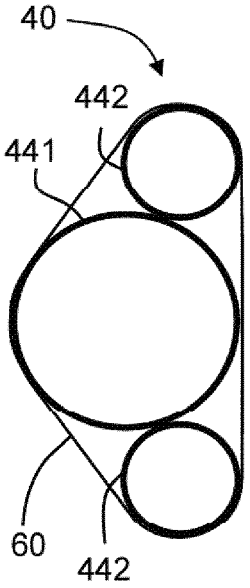
FIG. 7 is a transverse section of the second part of the wall of a boat according to another embodiment of the invention.

For example, these tubes 44 have smaller width at the top and bottom of the D, and larger width at the middle of the D. For example, as shown in FIG. 7, this assembly is made up of a circular tube 441 with a larger diameter surrounded by two tubes 442 with smaller diameters, one above and one below, where this assembly of tubes is held in contact by a sleeve 60 which surrounds the assembly of these tubes over the full length thereof.

According to the invention, the first element 30 and the second element 40 make up a part of one at least of the lateral wall 22 and the front wall 21. Thus, the first element 30 and the second element 40 constitute a portion (or the entirety) of the lateral wall 22, or a portion (or the entirety) of the front wall 21, or a portion (or the entirety) of the lateral walls 22 and the front wall 21.

The invention claimed is:

1. A boat comprising:

a wall (20) which comprises an inflatable and pliable front wall (21), an inflatable and pliable lateral wall (22), and a rear wall (23), wherein a prow of the boat is formed by the front wall (21), a totality of the prow being inflatable and pliable, and wherein lateral sides of the boat are formed by the lateral wall (22), a totality of the lateral sides being inflatable and pliable; and a bottom (10) that is flexible, the bottom (10) being radially edged towards the outside by the wall (20) which comprises the inflatable and pliable front wall (21), the inflatable and pliable lateral wall (22), and the rear wall (23), wherein at least one part of at least one among said lateral wall (22) and said front wall (21) is made of an inflatable first element (30) shaped as a plate having two parallel flat surfaces (31, 32), the inflatable first element (30) being assembled with an inflatable second element (40) whose section is D shaped with a flat portion (41), the flat portion (41) of the inflatable second element (40) being kept in contact with one of said flat surfaces of said inflatable first element (30), and wherein said inflatable second element (40) is located radially outward from said boat relative to said inflatable first element (30).

2. The boat according to claim 1, wherein said inflatable first element (30) being assembled with an inflatable second element (40) by an assembly device chosen among an attachment system (70), a flexible sleeve (60) at least partially surrounding said inflatable first element (30) and said inflatable second element (40), and a combination of the two.

3. The boat according to claim 2, wherein said inflatable first element (30) is located outside said inflatable second element (40).

4. The boat according to claim 2, wherein said inflatable first element (30) is located inside said inflatable second element (40).

5. The boat according to claim 2, wherein when only one part of said lateral wall (22) and said front wall (21) comprises said inflatable first element (30) and said inflatable second element (40), said wall (20) further comprises a progressive transition (25) which connects this part with the rest of the wall (20).

6. The boat according to claim 2, wherein all of said lateral wall (22) and said front wall (21) comprise said inflatable first element (30) and said inflatable second element (40).

7. The boat according to claim 1, wherein said inflatable first element (30) is located outside said inflatable second element (40).

8. The boat according to claim 7, wherein said inflatable first element (30) extends vertically downward below the bottom (10) of said boat.

9. The boat according to claim 8, wherein when only one part of said lateral wall (22) and said front wall (21) comprises said inflatable first element (30) and said inflatable second element (40), said wall (20) further comprises a progressive transition (25) which connects this part with the rest of the wall (20).

10. The boat according to claim 7, wherein when only one part of said lateral wall (22) and said front wall (21) comprises said inflatable first element (30) and said inflatable second element (40), said wall (20) further comprises a progressive transition (25) which connects this part with the rest of the wall (20).

11. The boat according to claim 1, wherein said inflatable first element (30) is located inside said inflatable second element (40).

12. The boat according to claim 11, wherein when only one part of said lateral wall (22) and said front wall (21) comprises said inflatable first element (30) and said inflatable second element (40), said wall (20) further comprises a progressive transition (25) which connects this part with the rest of the wall (20).

13. The boat according to claim 1, wherein when only one part of said lateral wall (22) and said front wall (21) comprises said inflatable first element (30) and said inflatable second element (40), said wall (20) further comprises a progressive transition (25) which connects this part with the rest of the wall (20).

14. The boat according to claim 13, wherein all of said lateral wall (22) comprises said inflatable first element (30) and said inflatable second element (40), and wherein said progressive transition (25) connects said lateral wall (22) and said front wall (21).

15. The boat according to claim 14, wherein said inflatable second element (40), and said progressive transition (25) delimit a single volume inflatable from a single point.

16. The boat according to claim 13, wherein said inflatable second element (40), and said progressive transition (25) delimit a single volume inflatable from a single point.

17. The boat according to claim 1, wherein all of said lateral wall (22) and said front wall (21) comprise said inflatable first element (30) and said inflatable second element (40).

18. The boat according to claim 1, wherein said front wall (21) and said inflatable second element (40) delimit a single volume inflatable from a single point.

19. The boat according to claim 1, wherein the bottom (10) comprises a fabric (11) on which a stiff removable floor (12) can be placed.

20. The boat according to claim 1, wherein a perimeter edge of the bottom (10) is fixed to a lower part of the front wall (21), a lower part of the lateral wall (22), and a lower part of the rear wall (23), the wall (20) radially bordering the perimeter edge of the bottom (10) on the outside.

* * * * *